United States Patent [19]

Chawla

[11] Patent Number: 5,045,245

[45] Date of Patent: Sep. 3, 1991

[54] DEVICE FOR ATOMIZING LIQUID OR FOR COMMINUTING GAS INTO SMALL BUBBLES

[75] Inventor: Jogindar M. Chawla, Ettlingen, Fed. Rep. of Germany

[73] Assignee: Caldyn Apparatebau GmbH, Ettlingen, Fed. Rep. of Germany

[21] Appl. No.: 500,616

[22] Filed: Mar. 28, 1990

[30] Foreign Application Priority Data

Apr. 22, 1989 [DE] Fed. Rep. of Germany ..... 3913334

[51] Int. Cl.[5] ..... B01F 3/04

[52] U.S. Cl. ..... 261/44.2; 261/44.5; 261/44.9; 261/DIG. 78

[58] Field of Search ..... 261/DIG. 78, 44.2, 44.5, 261/44.9, DIG. 13

[56] References Cited

U.S. PATENT DOCUMENTS

| | | | |
|---|---|---|---|
| 3,331,590 | 7/1967 | Battenfeld et al. | 261/DIG. 78 |
| 3,953,548 | 4/1976 | Knapp et al. | 261/DIG. 78 |
| 4,000,225 | 12/1976 | Heilig et al. | 261/DIG. 78 |
| 4,096,211 | 6/1978 | Rameau | 261/44.9 |
| 4,180,534 | 12/1979 | Cutler | 261/44.5 |
| 4,217,313 | 8/1980 | Dmitrievsky et al. | 261/DIG. 78 |
| 4,231,383 | 11/1980 | Eversole et al. | 261/DIG. 78 |

FOREIGN PATENT DOCUMENTS

| | | | |
|---|---|---|---|
| 1517502 | 11/1970 | Fed. Rep. of Germany | 261/DIG. 78 |
| 2053991 | 5/1972 | Fed. Rep. of Germany | 261/DIG. 78 |
| 2201607 | 8/1972 | Fed. Rep. of Germany | 261/DIG. 78 |
| 2648170 | 6/1980 | Fed. Rep. of Germany . | |
| 3024749 | 2/1982 | Fed. Rep. of Germany . | |
| 2627880 | 11/1982 | Fed. Rep. of Germany . | |
| 2226745 | 11/1984 | Fed. Rep. of Germany . | |
| 3619532 | 12/1986 | Fed. Rep. of Germany . | |
| 0025518 | 2/1980 | Japan | 261/DIG. 78 |
| 628251 | 2/1982 | Switzerland . | |

*Primary Examiner*—Tim Miles

*Attorney, Agent, or Firm*—Edwin E. Greigg; Ronald E. Greigg

[57] ABSTRACT

The invention relates to a device for atomizing liquid with the aid of gas or for comminuting gas into small bubbles with the aid of liquid, in which the gas and the liquid are joined into a two-phase mixture in a mixing chamber and mixed, and the inflow speeds and volumetric flows of the individual phases are selected such that the outflow speed of the two-phase mixture is equal to the characteristic sonic velocity. An essential feature is that to maintain the mixing ratio, the outlet cross section is adjustable.

15 Claims, 3 Drawing Sheets

DEVICE FOR ATOMIZING LIQUID OR FOR COMMINUTING GAS INTO SMALL BUBBLES

BACKGROUND OF THE INVENTION

The invention relates to improvements in a device for atomizing liquid with the aid of gas, or for comminuting gas into small bubbles with the aid of liquid, wherein the gas and the liquid are joined into a two-phase mixture in a mixing chamber and mixed, and wherein the inflow speeds and the volumetric flows of the various phases are selected, taking into account the status variables of the resultant two-phase mixture in view of the outflow cross section of the mixing chamber, such that the outflow speed of the two-phase mixture is approximately equal to the characteristic sonic velocity of the two-phase mixture, and the two-phase mixture leaves the mixing chamber with an abrupt pressure reduction.

A mixing device of this kind is known in the prior art from German Patent 26 27 880. The prior art device is distinguished by effective atomization of liquids or comminution of gas into many small bubbles with little expenditure of energy. The following discussion refers only to the atomization of liquids, but the invention is equally suitable for the comminution of gases.

In many fields of process technology, such as in drying technology or combustion technology, atomization devices for liquids are needed. Usually, mass transfer and/or heat exchange takes place between the atomized liquid and a gas. To this end, the liquid must be atomized as finely as possible, in order to attain a large phase boundary surface between the two substances.

In certain applications of the nozzle according to the invention, such as chemical desulfurizing of flue gas with milk of lime or cooling flue gas with injected water, the problem that arises is that the quantities of gas to be handled fluctuate severely. As a result, the amount of water to be atomized and needed for this purpose undergoes correspondingly severe fluctuations.

Experiments by the present applicant have shown, in the case of partial-load operation described, that the consumption of propellant gas increases sharply if the liquid quantity is reduced. This is likely to be due to the fact that the reduced throughput of liquid in the nozzle opens up a free cross section that is then filled up by the gas component.

Although a plurality of smaller-sized nozzles can be used to reduce the gas consumption in partial load operation, and can then be switched on or off as needed, nevertheless this process is very expensive because of the numerous nozzles required; nor can it be used in all cases.

If an attempt is made to reduce the gas pressure upstream of the nozzle and thereby reduce the gas consumption, relatively coarse atomization ensues, which is undesirable from a reaction standpoint. Furthermore, means for keeping the various pressure levels constant are needed, and so once again this method is expensive.

OBJECT AND SUMMARY OF THE INVENTION

It is the principal object of the present invention to improve the atomization device described above such that with a small liquid throughput, relatively little propellant gas and a correspondingly low expenditure of energy are sufficient. The atomization device according to the invention is accordingly equally suitable commercially for both full-load and partial-load operation.

According to the invention, this object is attained in that the size of the outflow cross section downstream of the mixing chamber is adjustable.

It has been found that a cross-sectional reduction performed in partial-load operation has no disadvantageous effect on the two-phase mixture, and in particular does not make it difficult to attain the characteristic sonic velocity of the mixture as described above. Contrarily, the cross-sectional reduction has the desired throttling effect on the gas flow, thereby drastically reducing the gas consumption.

Accordingly, the invention is based on the recognition that the liquid quantity can be reduced externally via a valve or the like, but contrarily, to reduce the quantity of gas it is necessary to reduce the outlet cross section of the nozzle, and that this reduction in the geometric arrangements makes it possible as before to adhere to the characteristic sonic velocity of the mixture in the reduced outlet cross section.

It is particularly suitable if the size of the outflow cross section is adjustable not only when the system is at a standstill but also continuously during operation. As a result, the nozzle can be adapted to current conditions at any time without any interruptions in operation. This adaptation is suitably accomplished automatically by means of a closed-loop control circuit, as a function of the gas or liquid throughput. The gas or liquid pressure itself can be used to bring about the adjustment of the outflow cross section.

For structurally realizing the adjustment principle, various options are available to one skilled in the art. It is favorable if the adjustment is effected by means of an insert insertable into the outflow cross section from the side of the mixing chamber; the insert may be hollow, so that it itself functions as an additional mixing chamber.

For adjustment, the insert may be connected to a control piston, which in turn is acted upon by the gas or liquid pressure, while on its other end it is loaded by a spring. The imposition of pressure on the control piston can be controlled by valves, and optionally by reducing valves as well.

However, it is also within the scope of the invention for the outflow cross section to be adjustable by means of perforated plates, throttles or screens.

The option also exists for the outflow cross section to be at least partially embodied by radially adjustable circumferential faces. The radial adjustment can also be generated based on an axial displacement motion.

Finally, the outflow cross section can also be embodied by radially elastic circumferential faces, such as a rubber-like annular diaphragm.

In all these cases, it is possible to adapt the outflow cross section to the variable flow quantities. The cross sectional adjustment naturally need not always be effected by means of the pressure of the gas or liquid; instead, an external actuation, whether by mechanical, hydraulic or pneumatic drive means, is also possible.

If a plurality of identical mixing nozzles are accommodated in a common nozzle head, then it is recommended that they be connected to a common liquid and gas supply line, while contrarily the pressure serving to adjust the cross section is deliverable to each individual nozzle in common or separately. As a result, the various nozzles can be staggered and switched over independently of one another. It is advantageously also possible to design the nozzles for different switchover points.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
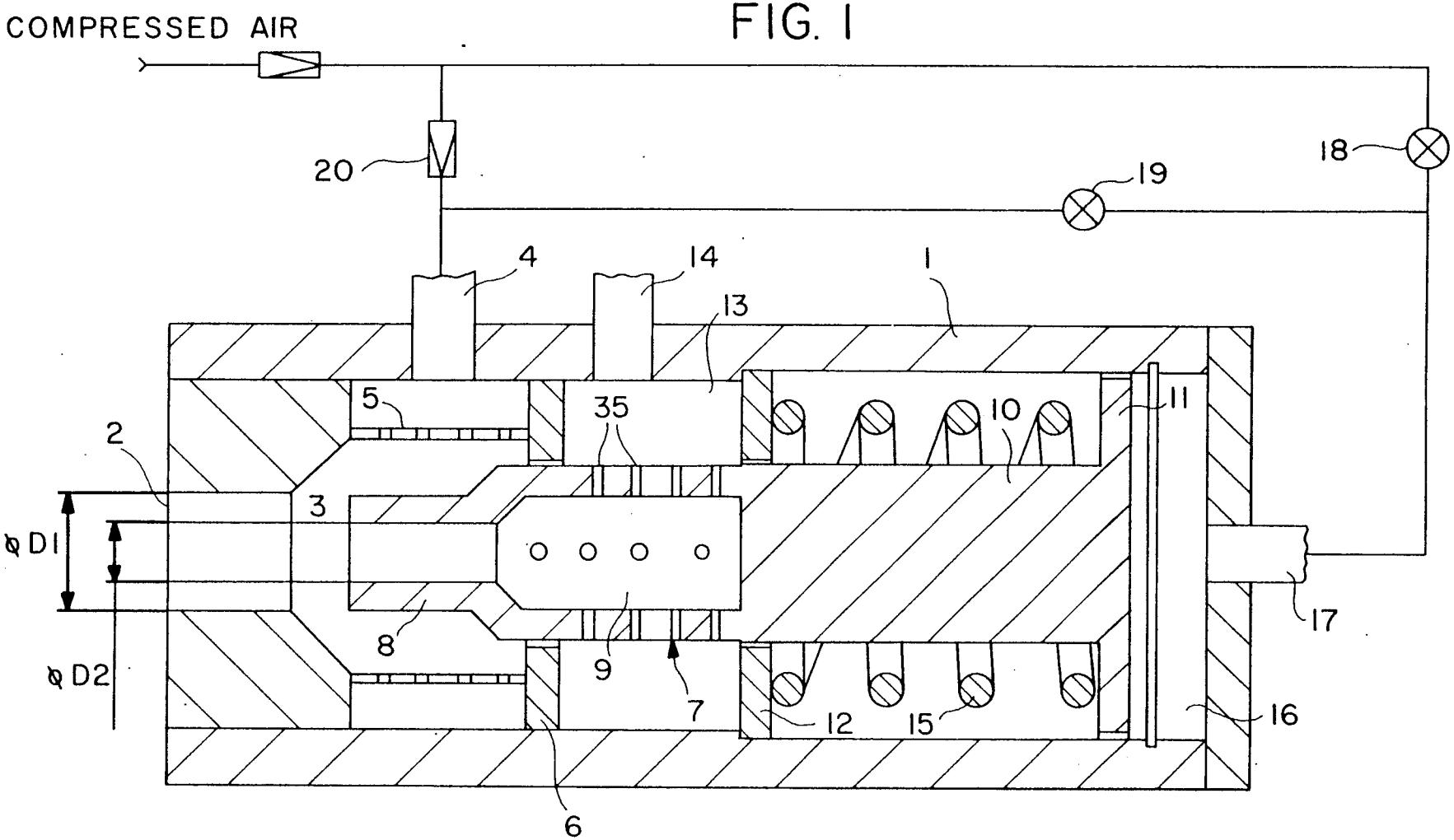
FIG. 1 is a longitudinal section through a nozzle structure according to the invention, with the associated circuitry.
Figure 2:
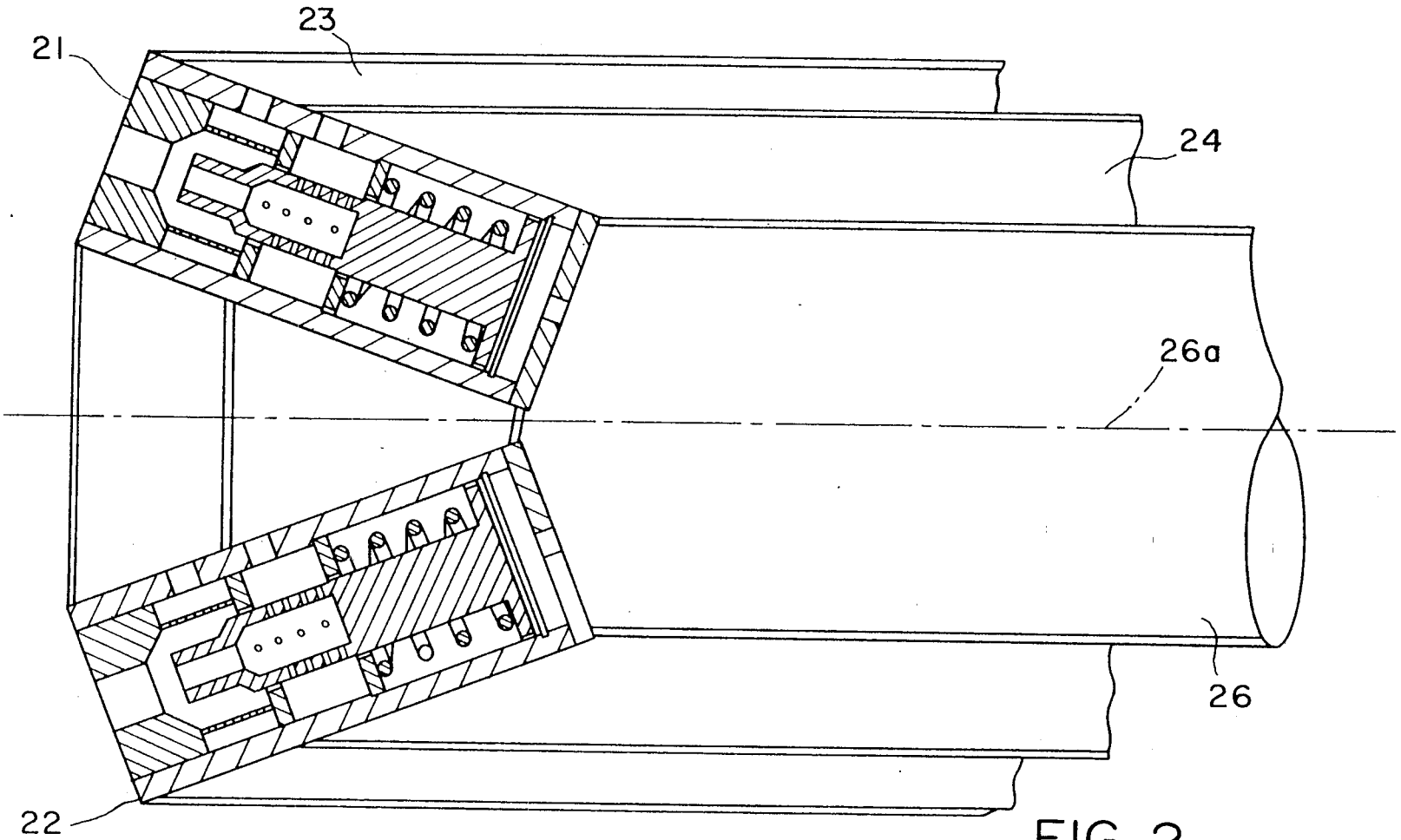
FIG. 2 shows the combination of two nozzles in accordance with FIG. 1.

FIGS. 1 and 2 show nozzles which have a structure as follows: a cylindrical housing 1 has a nozzle opening 2 on one end, having a diameter $D_1$. This opening widens axially inward into a mixing chamber 3, into which one medium, in the exemplary embodiment compressed air, can be delivered via a connection 4. To improve the distribution of the compressed air, the mixing chamber 3 is surrounded by a cylindrical perforated plate 5, which is disposed spaced radially apart from the cylindrical housing 1.

The right-hand end of the mixing chamber 3 is formed by a transverse wall 6, which has a central opening into which a cylindrical insert 7 is axially displaceably guided. On its left-hand end protruding into the mixing chamber 3, this insert has an outlet nozzle 8. Its outlet opening, of diameter $D_2$, is smaller than the outlet opening 2, while contrarily the outer diameter of the nozzle 8 is approximately equivalent to the diameter $D_1$ such that the outlet nozzle 8 may be inserted into nozzle 2.

On its other end, which in the position shown in FIG. 1 is located outside the mixing chamber 3, the insert 7 widens into a second mixing chamber 9. A fluid such as water is admitted into chamber 9 via radial bores 35. Connected to this mixing chamber 9 on the right is a rodlike extension 10 having a control piston While the control piston 11 is guided displaceably in the cylindrical housing 1, the rod 10 traverses an annular disk 12 fixed in the housing 1, which at the same time forms the right-hand limitation of an annular chamber 13 formed between the annular chamber 9 and the housing 1. The other medium, in the exemplary embodiment water, is delivered into this annular chamber 13 via a connection 14.

On its other side, the annular disk 12 serves to support a compression spring 15, which urges the insert 7 into the position shown. This position is intended for full-load operation of the nozzle.

The function is as follows: Compressed air and water are delivered through the connections 4 and 14, respectively. In the position of the insert 7 shown, compressed air is directed into chamber 3 via inlet 4 and the perforated plate 5 and a fluid such as water is admitted into the chamber 9 via inlet 14 and radial bores 35, and the mixing of the two phases does not occur until inside the mixing chamber 3. The inflow speeds and the volumetric flows are selected such that the outflow speed of the two-phase mixture at the outlet cross section 2 is equal to the characteristic sonic velocity of the mixture.

If the water supply is throttled because less liquid is needed, then the air throughput automatically increases, even though from the standpoint of the mixing ratio a reduction in the air supply would be required.

Figure 3:
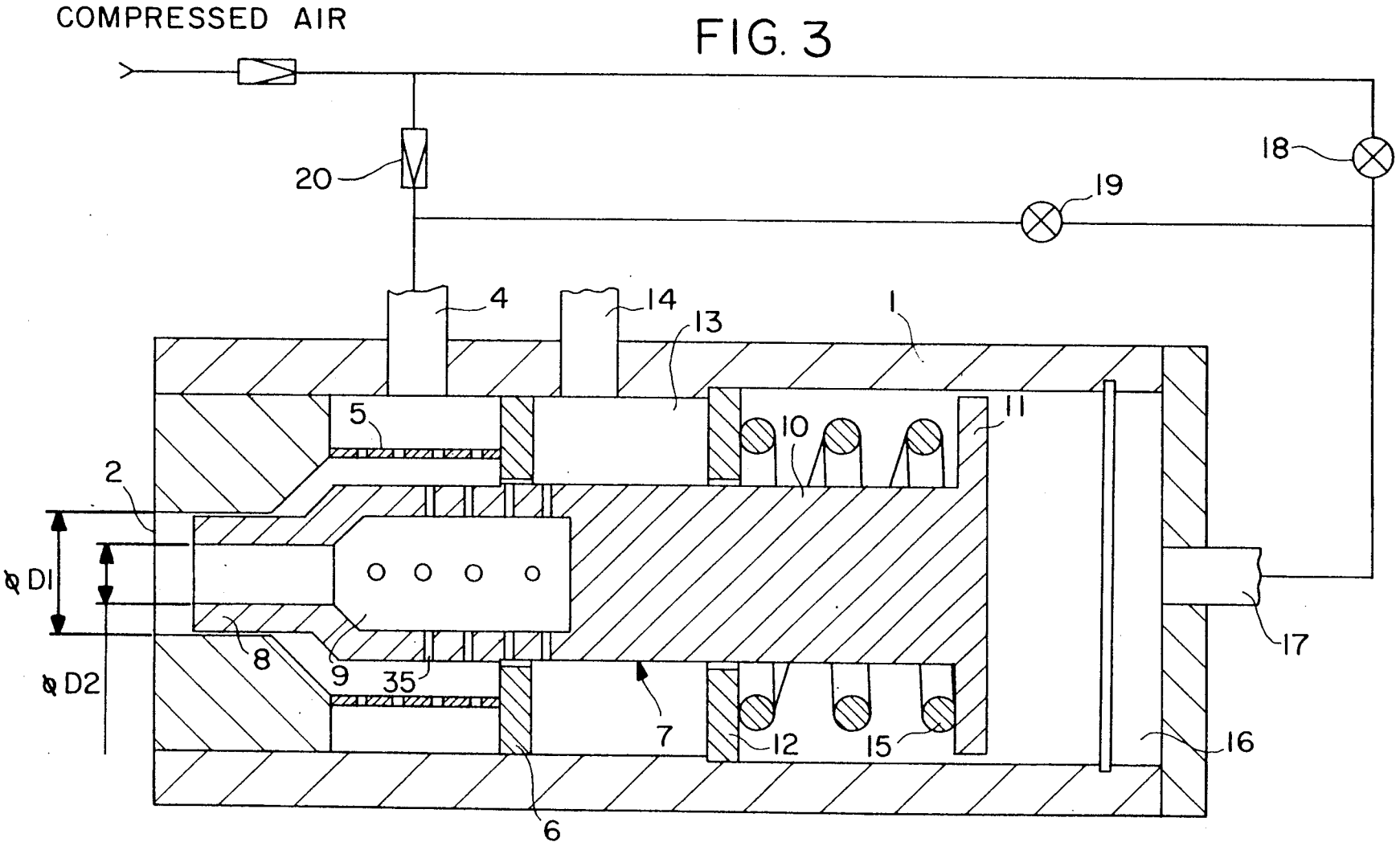
FIG. 3 illustrates a nozzle structure in a reduced size.

To maintain the desired mixing ratio, the insert 7 is displaced to the left counter to the spring force acting upon it, by the compressed air directed upon the outer surface face of the piston 11 until the nozzle 8 has moved to the left because of the compressed air acting against the spring 15 to completely traverse the mixing chamber 3 and fills the outlet cross section 2, preferably being flush with it at the upstream end. The mixing chamber 3 is then replaced by the mixing chamber 9, and the outlet cross section is reduced to the diameter $D_2$. In this position as shown in FIG. 3, the water enters into chamber 9 via radial bores 35 within the chamber 13 and air enters the chamber 9 via the radial bores 35 within the chamber 3. As a result of this cross-sectional reduction and the throttling action of the radial bores 35 in the insert 7, the air throughput is throttled such that it is again appropriate for the reduced water throughput.

The adjustment of the insert 7 in the exemplary embodiment is effected pneumatically by means of the compressed air itself. To this end, the cylindrical chamber 16 formed between the control piston 11 and the housing 1 communicates with the compressed air source via a connection 17 and a magnetic valve 18. If the magnetic valve 18 is opened, then the pressure from the compressed air network brings about the aforementioned switchover of the nozzle to partial-load operation as shown in FIG. 3.

If the nozzle is to be switched back to full-load operation again, then the valve 18 is closed and the cylindrical chamber 16 is made to communicate either with the atmosphere, or if the pressure medium is a gas that is not to be released into the atmosphere, such as helium or hydrogen, then the gas in the cylindrical chamber 16 is returned to the gas cycle. In the exemplary embodiment, this is effected via an additional line having a magnetic valve 19, which discharges into the gas supply line downstream of a pressure reducer 20.

FIG. 2 shows the combination of a plurality of nozzles using common supply conduits for the components to be mixed and the control medium. As can be seen, two nozzles 21 and 22 are connected here to the compressed air network via an outer ring line 23, and to the liquid source via an inner ring line 24, as well as to the control medium, via a central line 26.

If the two nozzles—and naturally more nozzles can be combined together in practice—are to be adjusted separately, then only the central line 26 needs to be correspondingly subdivided, as suggested by the partition **26*a*** shown in dashed lines. With this kind of staggered switchover of the nozzles, quasi-continuous adaptation of the throughput quantities to the need at the time can be attained when numerous nozzles are used.

The atomizing or comminuting device shown in the drawing serves merely to illustrate the principle. Depending on structural and process requirements, the atomizing nozzle can also be designed and constructed differently. In particular, it is possible to provide diverging tubular courses at the end of the mixing chamber.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A device for atomizing a liquid via a gas or for comminuting gas into small bubbles via a liquid, comprising a mixing chamber means, means for conveying said gas and liquid to said mixing chamber means for mixing therein, means for controlling inflow speeds and volumetric flows of said gas and said liquid from an outflow cross section (2) in view of pre-selected variables affecting a desired resultant mixture and further in view of a selected size of said outflow cross section leading from the mixing chamber means, an insert means (7) insertable into the outflow cross section, for adjustment of the outflow cross section (2), said insert means (7) is hollow and includes radial bores (35) which allows said insert means to function as an additional mixing chamber (9), said inflow speeds and said volumetric flows being selected such that an outflow speed of the resultant mixture is approximately equal to a characteristic sonic velocity of said resultant mixture, the resultant mixture being arranged to exit the mixing chambers (3, 9) with an abrupt pressure reduction, the size of the outflow cross section being adjustable.

2. A device as defined by claim 1, in which the adjustment is effected by means of a pressure prevailing in the gas or the liquid itself.

3. A device as defined by claim 1 in which the adjustment of the outflow cross section (2) is effected automatically as a function of the gas or liquid throughput.

4. A device as defined by claim 1, in which the insert means (7) is insertable into the outflow cross section (2) from an inlet side of the mixing chamber (3).

5. A device as defined by claim 1, in which the size of the outflow cross section (2) is adjustable during operation.

6. A device as defined by claim 5, in which the adjustment of the outflow cross section (2) is effected automatically as a function of the gas or liquid throughput.

7. A device as defined by claim 1, in which the insert means (7) is connected to a control piston (11) which in turn is acted upon by a pressure provided by said gas or said liquid.

8. A device as defined by claim 7, in which the pressure imposed upon the control piston (11) is controllable by valve means (18, 19).

9. A device as defined by claim 7, in which the control piston is acted upon by a spring means (15).

10. A device for atomizing a liquid via a gas or for comminuting gas into small bubbles via a liquid including a plurality of identical devices disposed in a common nozzle head and designed for identical switchover points in which each of said plurality of identical devices comprises a mixing chamber means, means for conveying said gas and liquid to said mixing chamber means for mixing therein, means for controlling inflow speeds and volumetric flows of said gas and said liquid from an outflow cross section (2) in view of preselected variables affecting a desired resultant mixture and further in view of a selected size of said outflow cross section leading from the mixing chamber means, said inflow speeds and said volumetric flows being selected such that an outflow speed of the resultant mixture is approximately equal to a characteristic sonic velocity of said resultant mixture, the resultant mixture being arranged to exit the mixing chamber with an abrupt pressure reduction, the size of the outflow cross section being adjustable.

11. A device as defined by claim 10, in which said plurality of identical devices (21, 22) have a common liquid and gas supply line (23, 24).

12. A device as defined by claim 10, in which the gas or liquid pressure serving to effect the adjustment is deliverable to the said plurality of identical devices (21, 22) via separate lines.

13. A device for atomizing a liquid via a gas or for comminuting gas into small bubbles via a liquid including a plurality of different devices disposed in a common nozzle head and designed for different switchover points in which each of said plurality of identical devices comprises a mixing chamber means, means for conveying said gas and liquid to said mixing chamber means for mixing therein, means for controlling inflow speeds and volumetric flows of said gas and said liquid from an outflow cross section (2) in view of preselected variables affecting a desired resultant mixture and further in view of a selected size of said outflow cross section leading from the mixing chamber means, said inflow speeds and said volumetric flows being selected such that an outflow speed of the resultant mixture is approximately equal to a characteristic sonic velocity of said resultant mixture, the resultant mixture being arranged to exit the mixing chamber means with an abrupt pressure reduction, the size of the outflow cross section being adjustable.

14. A device as defined by claim 13, in which said plurality of identical devices (21, 22) have a common liquid and gas supply line (23, 24).

15. A device as defined by claim 13, in which the gas or liquid pressure serving to effect the adjustment is deliverable to the said plurality of identical devices (21, 22) via separate lines.

* * * * *